US008516756B2

(12) United States Patent
Thielmann

(10) Patent No.: US 8,516,756 B2
(45) Date of Patent: Aug. 27, 2013

(54) DOOR PANEL WITH THERMAL BREAK

(75) Inventor: Jonathan D. Thielmann, Delray Beach, FL (US)

(73) Assignee: Secura-Seal Technologies LLC, Bensalem, PA (US)

( * ) Notice: Subject to any disclaimer, the term of this patent is extended or adjusted under 35 U.S.C. 154(b) by 0 days.

(21) Appl. No.: 12/578,113

(22) Filed: Oct. 13, 2009

(65) Prior Publication Data

US 2010/0269450 A1 Oct. 28, 2010

Related U.S. Application Data

(60) Provisional application No. 61/172,865, filed on Apr. 27, 2009.

(51) Int. Cl.

| | |
|---|---|
| ***E06B 5/00*** | (2006.01) |
| ***E06B 3/00*** | (2006.01) |
| ***E06B 1/00*** | (2006.01) |

(52) U.S. Cl.

USPC ..... 52/208; 52/210; 52/213; 52/204.53; 52/784.1; 52/455; 52/457

(58) Field of Classification Search

USPC ..... 52/208, 204.53, 204.54, 204.62, 52/204.591, 204.71, 204.72, 309.9, 717.01, 52/784.14, 784.15, 742.13, 745.15, 745.19, 52/784.1, 783.1–783.19, 582.1, 582.2, 578, 52/455–458; 428/116, 118, 73, 72, 60, 76, 428/327

See application file for complete search history.

(56) References Cited

U.S. PATENT DOCUMENTS

| | | | |
|---|---|---|---|
| 19,217 | A | 1/1858 | Tinney |
| 724,139 | A | 3/1903 | Smith |
| 946,305 | A | 1/1910 | Twyman |
| 982,828 | A | 1/1911 | Kelly |
| 1,009,978 | A | 11/1911 | Knappe |
| 1,021,862 | A | 4/1912 | Culver |
| 1,170,101 | A | 2/1916 | Pullets |

(Continued)

OTHER PUBLICATIONS

Dictionary.com, "Active," retrieved online at: http://dictionary.reference.com/browse/active (2010).

(Continued)

*Primary Examiner* — Jeanette E. Chapman

(74) *Attorney, Agent, or Firm* — Nelson Mullins Riley & Scarborough LLP; Anthony A. Laurentano; Neslihan I. Doran

(57) ABSTRACT

A door panel includes a frame, a laminate core, a plurality of thermally-insulative connectors, and an exterior skin. The frame defines a portion of an outer periphery of the panel and has an inner section and an outer section positioned, respectively, adjacent inner and outer portions of the panel. The laminate core is positioned between the inner section and the outer section of the frame. The plurality of thermally-insulative connectors connect the inner section and the outer section to the core. The exterior skin covers the frame. The core is a thermal barrier between the inner section and the outer section. The inner section and the outer section are formed from a thermally-insulative material. The core includes an inner layer formed from a thermally conductive material, and two outer layers formed from steel. The thermally-insulative connectors include a thermally-insulative jacket and a fastener positioned within the jacket.

1 Claim, 3 Drawing Sheets

(56) References Cited

U.S. PATENT DOCUMENTS 1,178,775 A 4/1916 Albright
1,345,967 A 7/1920 Smelser
1,468,958 A 9/1923 Champion
1,489,018 A 4/1924 Shultz
1,675,230 A 6/1928 Snyder
1,715,188 A 5/1929 Bullock
1,797,839 A 3/1931 Ramsay
1,974,269 A 9/1934 Gonder
1,977,726 A 10/1934 Jacobson
1,995,939 A 3/1935 Osten
2,207,065 A 7/1940 McCormick
2,248,719 A 7/1941 Owen
2,268,114 A 12/1941 Foster
2,541,421 A 2/1951 Hunter
2,552,369 A 5/1951 Currie
2,593,093 A 4/1952 Bjork
2,628,678 A 2/1953 Webster
2,719,342 A 10/1955 Hunt
2,753,020 A 7/1956 Ware
2,766,860 A 10/1956 Travis
2,805,451 A 9/1957 Evans
2,837,151 A 6/1958 Stroup
2,862,256 A 12/1958 Stroup
2,862,262 A 12/1958 Shea
2,880,471 A * 4/1959 Von Munchhausen ..... 52/404.1
2,928,144 A 3/1960 Persson
3,004,309 A 10/1961 Karodi
3,054,152 A 9/1962 Trammell
3,059,287 A 10/1962 Baruch
3,070,856 A 1/1963 Minick
3,077,644 A 2/1963 Kesling
3,098,519 A 7/1963 Myers
3,111,727 A 11/1963 Gerecke
3,126,051 A 3/1964 Sussin
3,163,891 A 1/1965 Seliger
3,184,806 A 5/1965 Bragman
3,252,255 A 5/1966 Marpe
3,289,377 A 12/1966 Hetman
3,295,257 A 1/1967 Douglass
3,335,524 A 8/1967 Carson
3,374,821 A 3/1968 White
3,383,801 A 5/1968 Dallaire
3,466,801 A 9/1969 Bohn
3,512,303 A 5/1970 Wright
3,590,530 A 7/1971 Duguay
3,590,531 A 7/1971 Childs
3,660,936 A 5/1972 Bryson
3,660,940 A 5/1972 Tavano
3,816,966 A 6/1974 Sause, Jr.
3,818,636 A 6/1974 Calais et al.
3,821,884 A 7/1974 Walsh
3,848,908 A 11/1974 Rich
3,857,199 A 12/1974 Frach et al.
3,910,155 A 10/1975 Wilson
3,959,927 A 6/1976 Good
4,018,022 A 4/1977 Fink
4,027,431 A 6/1977 Rackard
4,064,651 A 12/1977 Homs
4,128,967 A 12/1978 Kirsch
4,170,846 A 10/1979 Dumenil et al.
4,307,542 A 12/1981 Lense
4,317,312 A 3/1982 Heideman
4,322,914 A 4/1982 McGaughey
4,392,329 A 7/1983 Suzuki
4,413,446 A 11/1983 Dittrich
4,453,346 A 6/1984 Powell et al.
4,479,330 A 10/1984 Muller
4,496,942 A 1/1985 Matsuoka
4,535,563 A 8/1985 Mesnel
4,614,060 A 9/1986 Dumenil et al.
4,625,628 A * 12/1986 Ikemura et al. ..... 165/54
4,656,779 A 4/1987 Fedeli
4,656,799 A 4/1987 Maryon
4,716,693 A 1/1988 Webster
4,765,105 A 8/1988 Tissington et al.
4,768,316 A 9/1988 Haas
4,831,509 A 5/1989 Jones et al.
4,837,560 A 6/1989 Newberry
4,870,909 A 10/1989 Richter
4,936,049 A 6/1990 Hansen
5,007,202 A 4/1991 Guillon
5,020,292 A 6/1991 Strom et al.
5,029,911 A 7/1991 Daniels
5,030,488 A 7/1991 Sobolev
5,187,867 A 2/1993 Rawlings
5,293,726 A 3/1994 Schick
5,327,684 A 7/1994 Herbst
5,339,881 A 8/1994 Owens
5,349,782 A 9/1994 Yulkowski
5,373,674 A * 12/1994 Winter, IV ..... 52/309.9
5,379,518 A 1/1995 Hopper
5,446,997 A 9/1995 Simonton
5,467,559 A 11/1995 Owens
5,479,151 A 12/1995 Lavelle et al.
5,511,833 A 4/1996 Tashman et al.
5,521,585 A 5/1996 Hamilton
5,522,180 A 6/1996 Adler et al.
5,522,195 A 6/1996 Bargen
5,569,878 A 10/1996 Zielinski
5,584,142 A 12/1996 Spiess
5,605,013 A 2/1997 Hogston
5,638,639 A 6/1997 Goodman et al.
5,784,834 A 7/1998 Stutzman
5,786,547 A 7/1998 Zielinski
5,870,859 A 2/1999 Kitada
5,870,869 A 2/1999 Schrader
5,899,037 A * 5/1999 Josey ..... 52/267
5,964,060 A 10/1999 Furlong
6,041,552 A 3/2000 Lindahl
6,057,658 A 5/2000 Kovach et al.
6,082,047 A 7/2000 Comaglio et al.
6,105,313 A 8/2000 Holloway et al.
6,112,466 A 9/2000 Smith et al.
6,112,467 A 9/2000 Bark et al.
6,112,496 A 9/2000 Hugus et al.
6,151,849 A * 11/2000 Twigg et al. ..... 52/208
6,170,195 B1 1/2001 Lim
6,173,533 B1 1/2001 Cittadini et al.
6,181,089 B1 1/2001 Kovach et al.
6,202,353 B1 3/2001 Giacomelli
6,218,939 B1 4/2001 Peper
6,243,999 B1 6/2001 Silverman
6,289,643 B1 9/2001 Bonar
6,318,037 B1 11/2001 Hansen
6,442,899 B1 9/2002 Gledhill
6,490,832 B1 12/2002 Fischbach et al.
D470,252 S 2/2003 Castrey
6,546,682 B1 4/2003 DeBlock et al.
6,553,735 B1 4/2003 Wang Chen
6,568,131 B1 5/2003 Milano, Jr.
6,619,005 B1 9/2003 Chen
6,644,884 B2 11/2003 Gledhill
6,651,389 B2 11/2003 Minter et al.
6,763,647 B2 * 7/2004 Yeany ..... 52/786.1
6,772,818 B2 8/2004 Whitley et al.
6,786,005 B1 9/2004 Williams
6,871,902 B2 3/2005 Carson et al.
6,973,753 B2 12/2005 Liebscher
7,010,888 B2 3/2006 Tumlin et al.
7,086,206 B2 * 8/2006 Wang et al. ..... 52/506.01
7,124,538 B1 10/2006 Kline
7,145,436 B2 12/2006 Ichikawa et al.
7,185,468 B2 3/2007 Clark et al.
7,401,442 B2 * 7/2008 Clark et al. ..... 52/783.1
7,430,836 B2 * 10/2008 Sibbett ..... 52/208
7,487,616 B2 2/2009 Deaver
7,566,035 B2 7/2009 Bonshor
7,624,539 B2 12/2009 Speyer et al.
7,627,987 B2 12/2009 Thielmann et al.
7,665,245 B2 2/2010 Speyer et al.
7,685,774 B2 3/2010 Thielmann
7,685,775 B2 3/2010 Speyer et al.
7,685,776 B2 3/2010 Speyer et al.
7,698,872 B2 * 4/2010 Clark et al. ..... 52/783.1

| | | | | |
|---|---|---|---|---|
| 7,707,773 | B2 | 5/2010 | Thielmann et al. | |
| 7,719,213 | B2 | 5/2010 | Herman et al. | |
| 7,748,196 | B2 * | 7/2010 | Gula et al. | 52/783.1 |
| 2003/0033786 | A1 | 2/2003 | Yulkowski | |
| 2004/0068935 | A1 | 4/2004 | Ichikawa et al. | |
| 2005/0097842 | A1 | 5/2005 | Arcamonte et al. | |
| 2005/0102908 | A1 | 5/2005 | Martin | |
| 2006/0207199 | A1 | 9/2006 | Darnell | |
| 2006/0254177 | A1 * | 11/2006 | Wang et al. | 52/506.01 |
| 2007/0193140 | A1 * | 8/2007 | Carnick et al. | 52/208 |
| 2007/0289221 | A1 | 12/2007 | Speyer et al. | |
| 2009/0151259 | A1 | 6/2009 | Speyer et al. | |
| 2009/0165415 | A1 | 7/2009 | Salerno | |
| 2009/0165423 | A1 | 7/2009 | Salerno | |
| 2010/0077665 | A1 | 4/2010 | Speyer et al. | |

OTHER PUBLICATIONS

Patio Life—Operation, retrieved online at: http://www.rotohardware.com/Products/Patio%20Life/PL-Operation.htm (2006).

International Search Report for Application No. PCT/US2010/029383, dated May 25, 2010.

International Search Report for Application No. PCT/US2010/029206, dated Jun. 2, 2010.

International Preliminary Report on Patentability and Written Opinion for Application No. PCT/US2010/029206, dated Nov. 1, 2011.

* cited by examiner

DOOR PANEL WITH THERMAL BREAK

CROSS-REFERENCE TO RELATED APPLICATIONS

This application claims the benefit of U.S. Provisional Application No. 61/172,865, filed Apr. 27, 2009, which is incorporated herein by reference in its entirety.

BACKGROUND OF THE INVENTION

1. Field of the Invention

The disclosure relates generally to door and window panels, and, more specifically, to panels having a thermal break for improved thermal performance of the panel.

2. Description of the Related Art

Many types of panels exists for doors and windows using common types of materials, such as aluminum, wood, steel, and composites thereof. However, each type of material has its own disadvantages/advantages. For example, while a material, such as aluminum, can be formed with high-dimensional tolerances, this material is thermally conductive, and as such, provides poor thermal resistance. Alternatively, other materials, such as wood or plastics, have better thermal resistance, these materials are not as strong as other materials.

New types of sealing/locking systems have been introduced with door panels, which require particular types of edge profiles of the panel, and these profiles cannot be easily provided by certain materials (e.g., wood).

There is, therefore, a need for a door panel that is able to provide the advantages of multiple types of materials in terms of penetration/impact resistance, thermal performance, and the ability to have intricate edge profiles.

BRIEF SUMMARY OF THE INVENTION

Embodiments of the invention address deficiencies of the art with respect to effectively creating a thermally-efficient panel while providing penetration/impact resistance and the ability to have intricate edge profiles. For example, a panel includes a frame, a laminate core, a plurality of thermally-insulative connectors, and an exterior skin. The frame defines a portion of an outer periphery of the panel and has an inner section and an outer section positioned, respectively, adjacent inner and outer portions of the panel. The laminate core is positioned between the inner section and the outer section of the frame. The plurality of thermally-insulative connectors connect the inner section and the outer section to the core. The exterior skin covers the frame. The core is a thermal barrier between the inner section and the outer section. The inner section and the outer section are formed from a thermally conductive material. The core includes an inner layer formed from a thermally-insulative material, and two outer layers formed from steel. The thermally-insulative connectors include a thermally-insulative jacket and a fastener positioned within the jacket.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
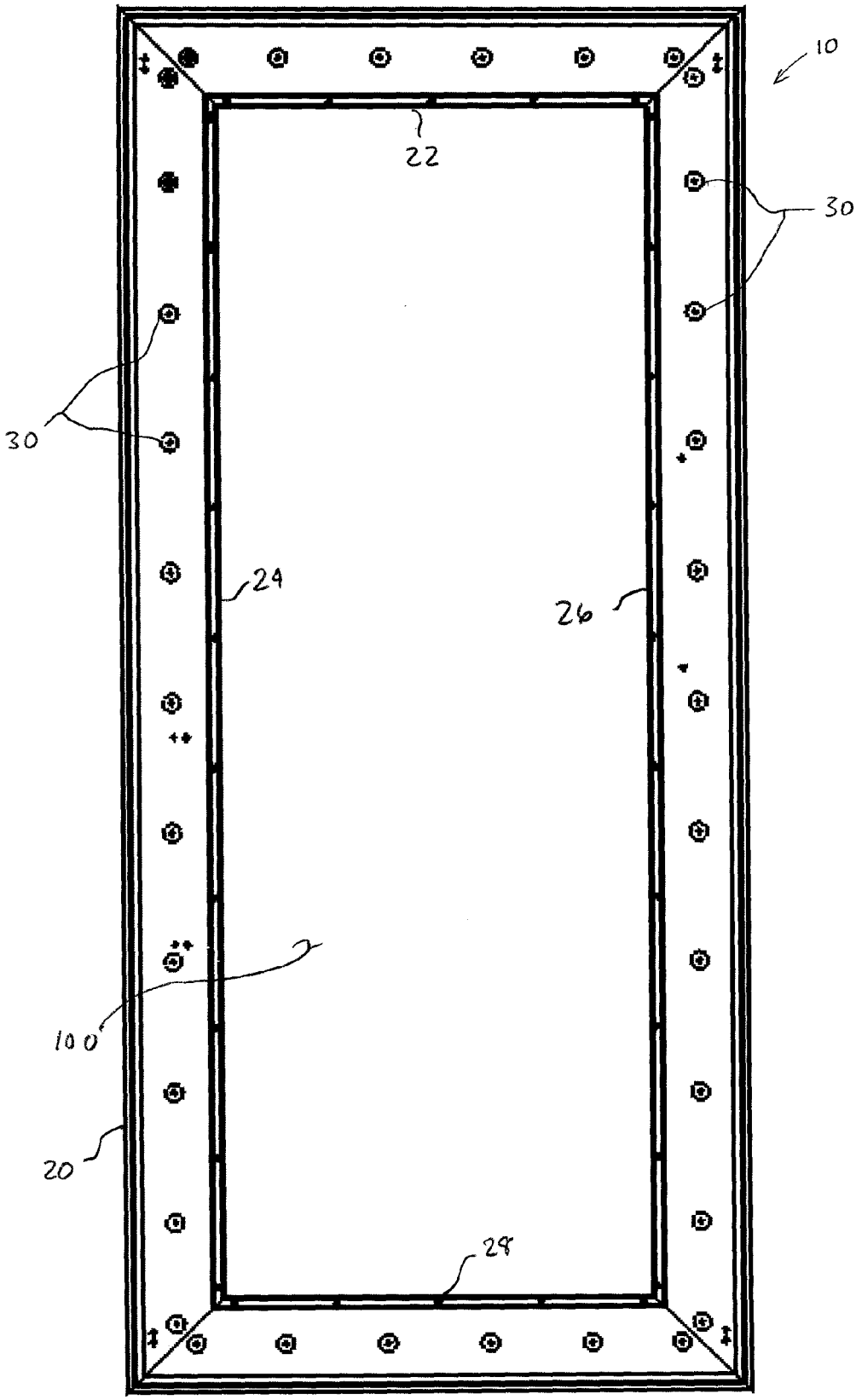
FIG. 1 is a front view of a panel in accordance with the inventive arrangements.

Referring to FIG. 1, an exemplar panel 10 for use with a door or window is illustrated. The panel 10 can be used with many types of doors and/or windows, such as pocket doors, sliding doors, French doors, entry doors, garage doors, sliding windows, single-hung windows, double-hung windows, casement windows, and awning windows. The panel 10 includes a frame 20 and core 100. Although the panel 10 is not limited in this manner, the frame 20 can define a portion of the outer periphery of the panel 10. Although not limited in this manner, the frame 20 can include separate portions such as a header rail 22, stile rails 24, 26, and a sill rail 28.

The frame 20 is not limited by the material used to the frame 20. For example, the frame 20 can be formed from fiberglass. However, in certain aspects of the panel 10, the frames are formed from an extruded aluminum. Forming the frame 20 from aluminum allows for both high-strength and reduced weight. Additionally, the frame 20 can be formed with an intricate edge profile 25 through, e.g., extrusion of the aluminum. By providing the capability to form intricate edge profiles 25, the panel can be used with new locking/sealing mechanisms.

Figure 2:
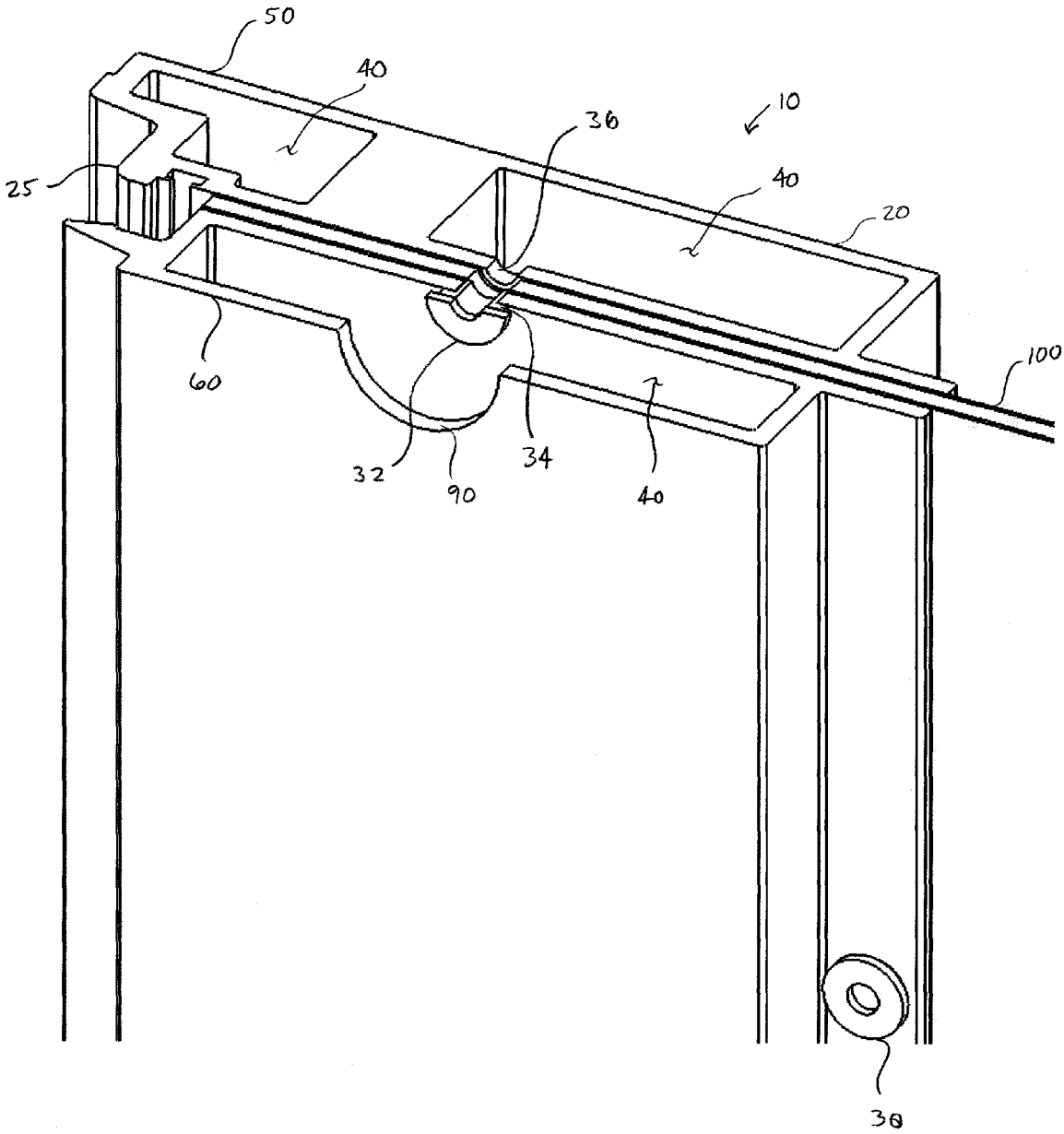
FIG. 2 is a cross-sectional, perspective view of the panel.

Referring to FIG. 2, a core 100 is sandwiched between the outer and inner portions 50, 60 of the frame 20. In certain aspects of the panel 10, the core 100 is configured as a break between the inner and outer portions 50, 60 of the frame 20 and the panel 10. For example, the core 100 can be configured as a thermal break. Additionally, the core 100 can be configured as a sound break that reduces the transmission of sound from one side of the panel 10 to another side of the panel 10. Still further, the core 100 can be configured as a physical break that structurally resists impacts against the panel 10 and/or the penetration of objects through the panel 10.

In certain aspects of the panel 10, the core 100 is formed from a single material, such as plastic, steel or glass. However, in other aspects of the panel 10, the core 100 is formed from multiple materials. Additionally, these multiple materials can be combined together, for example, as a laminate.

Figure 3:
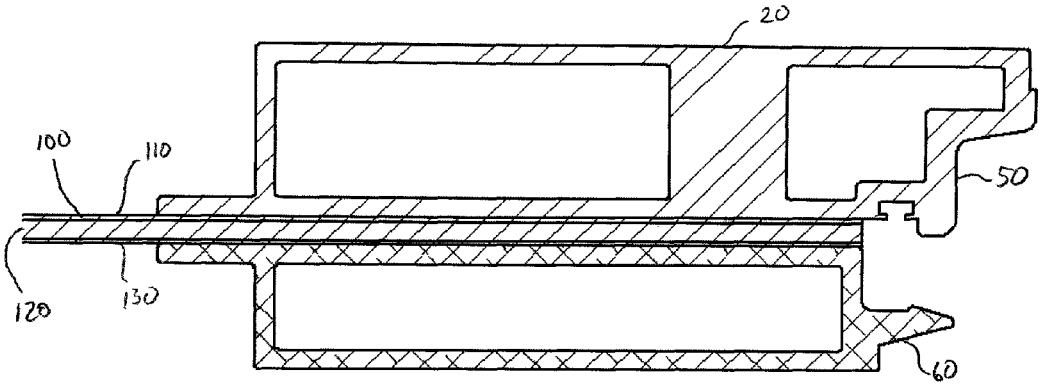
FIG. 3 is a cross-sectional view of the panel without a skin.

FIG. 3 illustrates an example in which a combination of different materials is used to form the core 100. In this particular aspect, a layer 120 of a thermally-insulative material, such as plastic (e.g., vinyl) or fiberglass, is sandwiched between two layers 110, 130 of a high-strength material, such as steel or aluminum. Since the thermal-insulative layer 120 separates the outer layers 110, 130, the core 100 can act as a thermal break. Additionally, the high-strength outer layers 110, 130 can act as a physical break that resists puncture. An alternate laminate, for example, could include a layer of high-strength material sandwiched between layers of a thermally-insulative material.

The panel 10 is not limited in the manner in which the core 100 is attached to the frame 20. However, in certain aspects of the panel 10, thermally-insulative connectors 30 are used to attach the core 100 to the frame 20. The thermally-insulative connectors 30 are configured to reduce the transfer of heat from one side of the panel 10 to the other side of the panel 10.

The panel 10 is not limited as to a particular type of thermally-insulative connector 30. However, in certain aspects the connector 30 includes a thermally-insulative jacket 34 through which a fastener 32, such as rivet, is positioned. For example, referring again to FIG. 3, the jacket 34 is positioned within a through-hole 36 that passes between the outer and inner portions 50, 60 of the frame 20 as well as the core 100. The jacket 34 can cover the thermally-conductive portions of the core 100, as well as the inner and outer portions 50, 60 of the frame 20.

The jacket 34 can also serve to thermally-isolate the fastener 32 from the thermally-conductive portions of the core 100, as well as the inner and outer portions 50, 60 of the frame 20. In this configuration, the thermally-insulative connector 30 is configured to both attach the core 100 to the outer and inner portions 50, 60 of the frame 20 as well as maintain a thermal break between the outer and inner portions 50, 60 of the frame.

Although not limited in this manner, the panel 10 may include access holes 90 within the frame 20. The access holes 90 are configured to permit access to the through-hole 36 into which the thermally-insulative jacket 34 is positioned.

Figure 4:
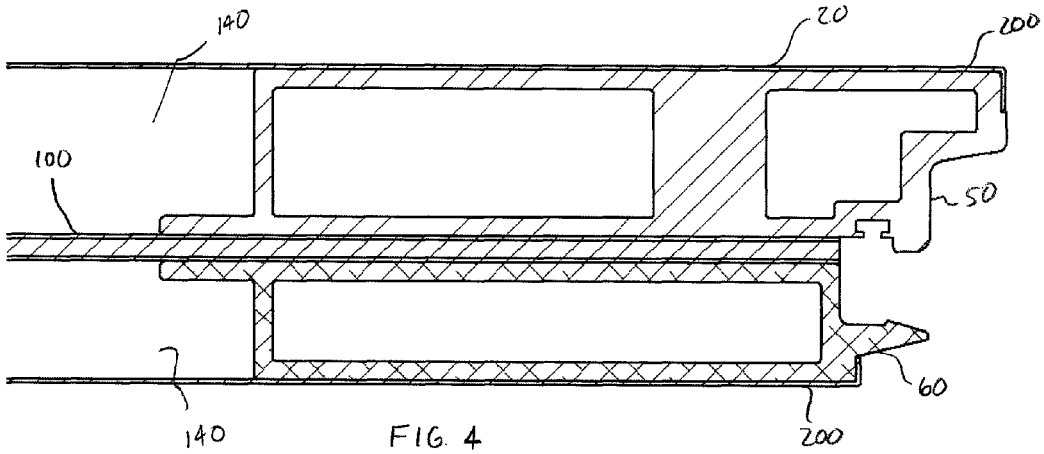
FIG. 4 is a cross-sectional view of the panel with a metallic skin.
Figure 5:
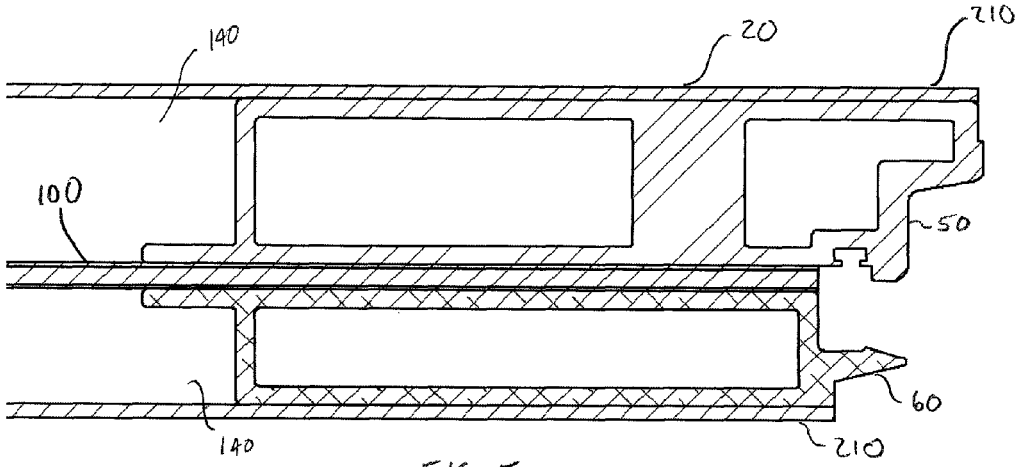
FIG. 5 is a cross-sectional view of the panel with a non-metallic skin.

Referring to FIGS. 4 and 5, the panel 10 is not limited as to a particular type of exterior skin 200, 210 covering the panel 10. For example, FIG. 4 illustrates the panel 10 being covered by a metal skin 200, such as steel. Alternatively, FIG. 4 illustrates the panel 10 being covered by a non-metallic skin 210, such as fiberglass. The manner by which the skins 200, 210 are connected to the frame 20 is not limited. For example, the skins 200, 210 may be connected to the frame 20 via welding, glue, and/or connectors.

To further reduce the transmission of sound and/or heat from one side of the panel 10 to another side of the panel 10, insulative material can be introduced into cavities 40, 140 within the frame and between the core and skin 200, 210, respectively. Materials capable of reducing the transmission of sound and/or heat are well known, and the panel 10 is not limited to any material so capable. For example, open or closed-cell foam may be introduced into the cavities 40, 140.

What is claimed is:

1. A door panel, comprising:

a frame defining a portion of an outer periphery of the panel and having an inner section and an outer section positioned, respectively, adjacent inner and outer portions of the panel wherein the inner section and the outer section have substantially the same width;

a laminate core positioned between the inner section and the outer section of the frame such that the inner section and the outer section extend parallel to each other along opposite sides of the core;

a plurality of thermally-insulative connectors connecting the inner section and the outer section to the core; and an exterior skin covering the frame, wherein the core is a thermal barrier between the inner section and the outer section, the inner section and the outer section are formed from a thermally conductive material, the core includes an inner layer formed from a thermally-insulative material, and two outer layers formed from steel, the thermally-insulative connectors include a thermally-insulative jacket and a fastener positioned within the jacket.

* * * * *